US005468399A

United States Patent [19]

Delfort et al.

[11] Patent Number: 5,468,399

[45] Date of Patent: Nov. 21, 1995

[54] COLLOIDAL PRODUCTS CONTAINING SULFUR AND/OR PHOSPHORUS AND/OR BORON, THEIR PREPARATION AND THEIR UTILIZATION AS ADDITIVES FOR LUBRICANTS

[75] Inventors: Bruno Delfort, Paris; Bertrand Daoudal, Pontigny; Jacques Lallement, Aubervilliers; Maurice Born, Nanterre; Jean-Claude Hipeaux, Colombes; Pierre Marchand, Orgeval, all of France

[73] Assignee: Institut Francais du Petrole, Rueil Malmaison, France

[21] Appl. No.: 153,926

[22] Filed: Nov. 18, 1993

[30] Foreign Application Priority Data

Nov. 18, 1992 [FR] France ..... 92 13933

[51] Int. Cl.[6] ..... C10M 159/12; C10M 135/10

[52] U.S. Cl. ..... 252/18; 252/33.2; 252/33.4; 252/49.8; 252/56 R; 252/49.6

[58] Field of Search ..... 252/18, 33.2, 33.4

[56] References Cited

U.S. PATENT DOCUMENTS

| | | | |
|---|---|---|---|
| 4,328,111 | 5/1982 | Watson et al. | 252/33.4 |
| 4,749,499 | 6/1988 | Damin et al. | 252/18 |
| 4,758,360 | 7/1988 | Bernasconi et al. | 252/18 |
| 5,080,812 | 1/1992 | Parc et al. | 252/32.7 R |
| 5,213,697 | 5/1993 | Vinci et al. | 252/18 |
| 5,324,440 | 6/1994 | Delfort et al. | 252/33.2 |
| 5,346,636 | 9/1994 | Parc et al. | 252/49.9 |

FOREIGN PATENT DOCUMENTS

| | | |
|---|---|---|
| 0536020 | 4/1993 | European Pat. Off. . |
| 0562912 | 9/1993 | European Pat. Off. . |
| 1394739 | 8/1963 | France . |
| 2645168 | 10/1990 | France . |
| 912561 | 12/1962 | United Kingdom . |
| WO88/04685 | 6/1988 | WIPO . |

*Primary Examiner*—Jacqueline V. Howard
*Attorney, Agent, or Firm*—Millen, White, Zelano & Branigan

[57] ABSTRACT

Colloidal products are described which contain an element selected from sulphur, phosphorus and possibly boron, as well as an element chosen from metal alkalis, alkaline earth metals and zinc, micellized in at least one detergent agent. They can be obtained in micelle form by reaction of at least one mineral acid or organic acid, containing sulphur and/or phosphorus and possibly an acid containing boron, these acids being directly introduced or formed in situ with at least one basic derivative containing a alkali metal and/or an alkaline earth metal and/or zinc, in the presence of at least one surface active agent. The colloidal products can be used as wear resistance and extreme pressure additives for lubricants.

31 Claims, No Drawings

COLLOIDAL PRODUCTS CONTAINING SULFUR AND/OR PHOSPHORUS AND/OR BORON, THEIR PREPARATION AND THEIR UTILIZATION AS ADDITIVES FOR LUBRICANTS

The invention relates to new colloidal products which are compatible with lubricating oils, their preparation, their use as additives with wear resistance and extreme pressure action in mineral and synthetic oils, for example in engine lubricants, gear lubricants, hydraulic fluids, oils for metal working, greases, etc.

The new products contain at least one element selected from sulphur and phosphorus and possibly boron, as well as an element selected from calcium, magnesium and zinc, all of these elements being in the colloidal state.

Superbasic detergent additives have been known for a long time. Certain of them, and their preparation, have been described for example in U.S. Pat. Nos. 2,865,956; 3,150,088; 3,537,996; 3,830,739; 3,865,737; 3,953,519; 3,966,621; 4,148,740 and 4,505,830 and the French patent 2.101.813. Variations of the reaction do exist, which in particular use carbonates, preformed from alkoxides and $CO_2$ before being placed in contact with the alkaline or alkaline earth salt of the acid compound; they are described particularly in U.S. Pat. Nos. 2,956,018, 4,965,003 and 4,965,004.

It is also known to modify superbasic detergents by incorporation of boron, derivatives, as described for example in U.S. Pat. Nos. 3,907,691, 3,929,650, 4,965,003 and 4,965,004.

Finally, the modification of superbasic detergent additives by certain carboxylic acids, boric acids or phosphoric acids has also been described in U.S. Pat. No. 4,328,111, as well as in the published French patent application 2 689031 (which corresponds to the published European application 0562912).

Furthermore, in French patent application FR-A-2,645,168, the preparation of thiophosphoric compounds by reaction of at least one phosphorus sulphide with at least one detergent additive, termed "superbasic", is described.

It has now been discovered that it was possible to prepare colloidal products containing sulphur and/or phosphorus and possibly boron, by reaction of at least one mineral or organic acid containing sulphur and/or phosphorus and possibly at least one mineral acid containing boron, with at least one basic derivative of alkaline or alkaline earth metal or of zinc, in the presence of at least one surface active agent.

In general, the preparation of colloidal products according to the invention can be carried out as follows:

In the presence of at least one surface active agent, at least one mineral or organic acid (directly introduced or formed in situ)is reacted with a non-micellized micellized alkali metal, alkaline earth, or zinc, non-micellized base derivative, the reaction temperature being in the range between the ambient temperature (20° C.) and 140° C. for a duration of, for example, 30 minutes to 7 hours.

The reaction medium generally contains a solvent, for example an aliphatic or cycloaliphatic hydrocarbon (such as, for example, hexane, cyclohexane, heptane, octanes or nonanes), an aromatic hydrocarbon (such as toluene or xylenes), tetrahydrofuran, or carbon sulphide and possibly a dilution oil. In order to promote micellization of the product, an amine (such as triethylamine), a quaternary ammonium compound, for example a salt (such as methyltrioctylammonium chloride, hydrazine or an aliphatic monoalcohol such as for example methanol can be added.

The reaction is generally followed by filtration of the solids present in the medium and removal of the solvent(s) used.

The surface active agent used in the preparation of colloidal products is generally a sulphonic acid, such as alkylarylsulphonic acids or salts thereof.

The acids used in the preparation of the products according to the invention can be introduced directly into the reaction medium or be formed therein (in situ) by suitable reaction.

Sulphurated carboxylic acids corresponding to the general formula below can be cited as acids used directly in the reaction medium:

$X—R^1—Sx—R^3—Sy—R^2—COOH$ in which $R^1$ and $R^2$ each represent a divalent hydrocarbon radical, for example an alkylene radical with 1 to 6 carbon atoms, X represents a hydrogen atom or a carboxylic grouping; x and y each have an average value of 1 to 4 when $R^3$ is a divalent hydrocarbon radical and the sum (x+y) has an average value of 1 to 4 when $R^3$ represents a simple bond.

More particularly, when $R^3$ is a simple bond and X represents COO H, the sulphurated carboxylic acids are in the form $$HOOC—R^1—S_{(x+y)}—R^2—COOH$$

and examples can be given such as thio-, dithio-, trithio- and tetrathio-diglycolic acids, -dipropionic and -dibutyric acids, as well as 2.2'-dithiodibenzoic acid.

When $R^3$ is a divalent hydrocarbon radical and X is a carboxylic grouping, the acids are in the form $$HOCO—R^1—Sx—R^3—Sy—R^2—COOH$$

examples of which are: bis-methylene and bis-ethylene (thio-, dithio- and trithioacetic acids) and bis-methylene and his-ethylene (thio-, dithio-, and trithiopropionic acids).

Finally, when $R^3$ is a simple bond and X is a hydrogen atom, the acids are in the form $$HR^1—S_{(x+y)}—R^2—COOH$$

examples of which are ethylthio-, dithio- and trithio-acetic, -propionic and -butyric acids.

Methods for the preparation of these sulphurated carboxylic acids have been described in French patent application 2689031 already cited above.

During the preparation of colloidal products according to the invention, acids formed in situ are used, these acids being able, more particularly, to be formed from, on the one hand, phosphorus sulphides, in particular $P_4S_{10}$ and their derivatives, and on the other hand water and/or an aliphatic monoalcohol such as, for example, methanol.

Organic acids containing sulphur directly introduced and mineral acids containing sulphur and phosphorus formed in situ can be used together with at least one acid containing phosphorus or boron directly introduced or formed in situ from the corresponding oxides. In this case, therefore, orthoboric and metaboric acids or phosphoric acid $H_3PO_4$ and derivatives thereof can be used directly, or acids used which are formed in situ from a phosphorus oxide such as $P_2O_5$ and/or a boron oxide such as $B_2O_3$ on the one hand, and on the other hand water and/or at least one aliphatic alcohol such as, for example, methanol.

Alkaline or alkaline earth derivatives used in the preparation of colloidal products according to the invention can consist, more particularly, of oxides, hydroxides carbonates or hydroxycarbonates. For example, mention could be made of oxides of calcium and magnesium, hydroxides of calcium or of magnesium, hydroxycarbonates of calcium and magnesium and carbonates of calcium and magnesium. Zinc oxide could also be used.

The colloidal products obtained are stable, soluble in mineral and synthetic lubricants and are characterized by their sulphur and/or phosphorus and possibly boron content and by their calcium, magnesium and/or zinc content:

the sulphur content can be up to approximately 30% by weight; the phosphorus content up to approximately 15% by weight; the possible boron content up to approximately 10% by weight;

the calcium content can be up to approximately 25% by weight, the magnesium content up to approximately 20% by weight and the zinc content up to approximately 25% by weight.

The colloidal character of the products according to the invention is verified by dialysis through a latex membrane. Analyses of sulphur and/or phosphorus and possibly of boron localizes these elements in the fraction which has not dialyzed (the concentrate) which constitutes the colloidal part of the additive.

Colloidal compounds containing sulphur and/or phosphorus and possibly boron according to the invention are excellent wear resistance and extreme pressure additives. Wear resistance and extreme pressure additives are incorporated into lubricants when these are for lubricating parts subjected to high mechanical stresses, such as those distributed to heat engines, gears, rolling bearings or axial bearings. High mechanical stresses also occur during metal machining involving cutting or shaping.

Furthermore, colloidal compounds containing sulphur and/or phosphorus and possibly boron according to the invention possess the advantage of high thermal stability, which means that they can be used in lubricants for use at very high temperatures, which can reach 160° C., as in certain harsh engine crank cases, in highly loaded transmissions or in high speed metal cutting.

When using the products according to the invention as additives for lubricating oils and greases, they can be incorporated therein, for example in a concentration of 0.1 to 25% by mass, preferably of 1 to 15% by mass.

Lubricating oils (or greases) moreover generally contain one or more additives such as additives to improve the viscosity index, additives for lowering the pour point, antioxidants, anti-corrosion additives, additives for preventing copper corrosion, detergents, wear-resistance additives, additives for anti-foaming, dispersants, and friction reducers, with which the products according to the invention are compatible.

The following examples illustrate the invention without limitation thereof.

EXAMPLE 1

32.0 g of an alkylarylsulphonic acid with an equivalent molar mass equalling 700, 20.0 g of 100 Neutral oil, 15.4 g of CaO lime, 5 g of methanol, 1 g of water and 75 ml of tetrahydrofuran are introduced into a reactor equipped with an agitator. After agitation for 30 minutes, in 5 hours 15.6g of dithiodiglycolic acid; previously dissolved in 50 ml of tetrahydrofuran is introduced. The mixture is agitated at 50° for 2 hours, then following a return to ambient temperature, the reaction medium is filtered. After evaporation of the solvents under low pressure, 56 g of a limpid, homogeneous product is recovered, containing:

Ca=4.62% by weight

S=7.40% by weight

EXAMPLE 2

30.0 g of an alkylarylsulphonic acid with an equivalent molar mass equalling 700, 30.0 g of 130 Neutral oil, 15.0 g of CaO lime, 13.21 g of phosphorus pentasulphide, 400 ml of xylene and 100 ml of tetrahydrofuran are introduced into a reactor equipped with an agitator, a Dean and Stark separator and a draining funnel. After mixing, a solution of 9.64 g of water in 150 ml of tetrahydrofuran is introduced drop-by-drop at a temperature not exceeding 50° C. The medium is then heated to within a range of 50° C. and 70° C. for 2 hours and then, after removal of tetrahydrofuran and water by distillation, the medium is heated to the reflux temperature of xylene for 2 hours. After return to the ambient temperature, the medium is filtered, then the filtrate is evaporated under low pressure. 70 g of a limpid, liquid, homogeneous product is recovered, containing:

Ca=6.40% by weight

P=4.05% by weight

S=3.80% by weight

EXAMPLE 3

20.0 g of an alkylarylsulphonic acid with an equivalent molar mass equalling 700, 20.0 g of 130 Neutral oil, 20.0 g of Ca(OH)2 lime, 15.0 g of phosphorus pentasulphide and 300 ml of xylene is introduced into a reactor equipped with an agitator, a Dean and Stark separator and a draining funnel. After mixing, a solution of water and tetrahydrofuran is added drop-by-drop at a temperature in the range of 50° C. and 70° C. for two hours, then, following removal of tetrahyrofuran and water by distillation, the medium is heated to the reflux temperature of xylene for 2 hours. After return to the ambient temperature, the medium is filtered, then the filtrate is evaporated under low pressure. 49.6 g of a limpid, liquid, homogeneous product is recovered, containing:

Ca=8.40% by weight

P=4.04% by weight

S=4.50% by weight

EXAMPLE 4

20.0 g of an alkyarylsulphonic acid with an equivalent molar mass equalling 700, 20.0 g of 130 Neutral oil, 25.0 g of CaO lime, 15.0 g of phosphorus pentasulphide, 350 ml of xylene and 100 ml of tetrahydrofuran are introduced into a reactor equipped with an agitator, a Dean and Stark separator and a draining funnel. After mixing, a solution of 12.20 g of water in 80 ml of tetrahydrofuran is introduced drop-by-drop at a temperature not exceeding 50° C. The medium is then heated to a temperature with the range of 50° C. and 70° C. for 5 hours, then, after removal of tetrahydrofuran and water by distillation, the medium is heated to the reflux temperature of xylene for 2 hours. After return to the ambient temperature, the medium is filtered, then the filtrate is evaporated under low pressure. 55.7 g of a limpid, liquid, homogeneous product is recovered, containing:

Ca=13.60% by weight

P=4.90% by weight

S=9.60% by weight

EXAMPLE 5

20.0 g of an alkyarylsulphonic acid with an equivalent molar mass equalling 700, 20.0 g of 130 Neutral oil, 26.4 g of Ca(OH)2 lime, 15.0 g of phosphorus pentasulphide, 300 ml of xylene, 40 ml of tetrahydrofuran and 50 ml of carbon sulphide are introduced into a reactor equipped with an agitator, a Dean and Stark separator and a draining funnel. After mixing, a solution of 12.16 g of water in 40 ml of tetrahydrofuran is introduced drop-by-drop at a temperature not exceeding 50° C. The medium is then heated to a temperature with the range of 50° C. and 70° C. for 2 hours, then, after removal of carbon sulphide, tetrahydrofuran and water by distillation, the medium is heated to the reflux temperature of xylene for 2 hours. After return to the ambient temperature, the medium is filtered, then the filtrate is evaporated under low pressure. 54.9 g of a limpid, liquid, homogeneous product is recovered, containing:

Ca=10.85% by weight

P=4.45% by weight

S=10.50% by weight

EXAMPLE 6

20.0 g of an alkyarylsulphonic acid with an equivalent molar mass equalling 700, 20.0 g of 130 Neutral oil, 15.4 g of CaO lime, 15.0 g of phosphorus pentasulphide, 700 ml of xylene and 50 ml of carbon sulphide are introduced into a reactor equipped with an agitator, a Dean and Stark separator and a draining funnel. After mixing, a solution of 12.16 g of water in 50 ml of tetrahydrofuran is introduced drop-by-drop at a temperature not exceeding 50° C. The medium is then heated to a temperature with the range of 50° C. and 70° C. for 2 hours, then, after removal of carbon sulphide, tetrahydrofuran and water by distillation, the medium is heated to the reflux temperature of xylene for 2 hours. After return to the ambient temperature, the medium is filtered, then the filtrate is evaporated under low pressure. 56.1 g of a limpid, liquid, homogeneous product is recovered, containing:

Ca=9.40% by weight

P=5.70% by weight

S=9.90% by weight

EXAMPLE 7

20.0 g of an alkyarylsulphonic acid with an equivalent molar mass equalling 700, 20.0 g of 130 Neutral oil, 22.7 g of CaO lime, 5 ml of methanol and 450 ml of xylene are introduced into a reactor equipped with an agitator, a Dean and Stark separator and a draining funnel. The mixture is heated to 50° C. for 30 minutes, then the methanol and water from the reaction is removed by distillation. After return to the ambient temperature, 18.0 g of phosphorus pentasulphide is introduced into the reactor and dispersed in the medium. Then, a solution of 12.16 g of water in 50 ml of tetrahydrofuran is introduced drop-by-drop at a temperature not exceeding 50° C. The medium is then heated to a temperature with the range of 30° C. and 50° C. for 3 hours, then, after removal of tetrahydrofuran and water by distillation, the medium is heated to the reflux temperature of xylene for 2 hours. After return to the ambient temperature, the medium is filtered, then the filtrate is evaporated under low pressure. 55.1 g of a limpid, liquid, homogeneous product is recovered, containing:

Ca=12.20% by weight

P=4.55% by weight

S=12.20% by weight

EXAMPLE 8

20.0 g of an alkyarylsulphonic acid with an equivalent molar mass equalling 700, 20.0 g of 130 Neutral oil, 20.0 g of CaO lime, 14.8 g of phosphorus pentasulphide and 300 ml of xylene are introduced into a reactor equipped with an agitator, a Dean and Stark separator and a draining funnel. After mixing, 2.2 g of phosphoric acid and 2.0 g of hydrazine is introduced, then a solution of 9.60 g of water in 50 ml of tetrahydrofuran is introduced drop-by-drop at a temperature not exceeding 50° C. The medium is then heated to a temperature with the range of 50° C. and 70° C. for 3 hours, then, after removal of tetrahydrofuran and water by distillation, the medium is heated to the reflux temperature of xylene for 2 hours. After return to the ambient temperature, the medium is filtered, then the filtrate is evaporated under low pressure. 50.3 g of a limpid, liquid, homogeneous product is recovered, containing:

Ca=4.05% by weight

P=4.60% by weight

S=8.25% by weight

EXAMPLE 9

20.0 g of an alkyarylsulphonic acid with an equivalent molar mass equalling 700, 20.0 g of 130 Neutral oil, 40.5 g of calcium carbonate, 15.0 g of phosphorus pentasulphide, 300 ml of xylene and 100 ml of tetrahydrofuran are introduced into a reactor equipped with an agitator, a Dean and Stark separator and a draining funnel. After mixing, a solution of 12.16 g of water in 50 ml of tetrahydrofuran is introduced drop-by-drop at a temperature not exceeding 50° C. The medium is then heated to a temperature with the range of 50° C. and 70° C. for 2 hours, then, after removal of tetrahydrofuran and water by distillation, the medium is heated to the reflux temperature of xylene for 2 hours. After return to the ambient temperature, the medium is filtered, then the filtrate is evaporated under low pressure. 34 g of a limpid, liquid, homogeneous product is recovered, containing:

Ca=4.86% by weight

P=0.69% by weight

S=5.60% by weight

EXAMPLE 10

20.0 g of an alkyarylsulphonic acid with an equivalent molar mass equalling 700, 20.0 g of 130 Neutral oil, 25 g of magnesium Mg(OH)2, 15.0 g of phosphorus pentasulphide, 200 ml of xylene and 100 ml of tetrahydrofuran are introduced into a reactor equipped with an agitator, a Dean and Stark separator and a draining funnel. After mixing, a solution of 12.2 g of water in 70 ml of tetrahydrofuran is introduced drop-by-drop at a temperature not exceeding 50° C. The medium is then heated to a temperature with the range of 50° C. and 70° C. for 2 hours, then, after removal of tetrahydrofuran and water by distillation, the medium is heated to the reflux temperature of xylene for 2 hours. After return to the ambient temperature, the medium is filtered, then the filtrate is evaporated under low pressure. 45 g of a limpid, liquid, homogeneous product is recovered, containing:

Mg=5.5% by weight

P=7.1% by weight

S=3.7% by weight

EXAMPLE 11

20.0 g of an alkyarylsulphonic acid with an equivalent molar mass equalling 700, 20.0 g of 130 Neutral oil, 22.7 g of CaO lime, 15.0 g of phosphorus pentasulphide, 6.9 g of phosphorus pentoxide, 450 ml of xylene and 100 ml of tetrahydrofuran are introduced into a reactor equipped with an agitator, a Dean and Stark separator and a draining funnel. After mixing, a solution of 12.16 g of water in 50 ml of tetrahydrofuran is introduced drop-by-drop at a temperature not exceeding 50° C. The medium is then heated to a temperature with the range of 50° C. and 70° C. for 2 hours, then, after removal of tetrahydrofuran and water by distillation, the medium is heated to the reflux temperature of xylene for 2 hours. After return to the ambient temperature, the medium is filtered, then the filtrate is evaporated under low pressure. 48 g of a limpid, liquid, homogeneous product is recovered, containing:

Ca=7.6% by weight

P=5.8% by weight

S=1.9% by weight

EXAMPLE 12

30.0 g of an alkyarylsulphonic acid with an equivalent molar mass equalling 700, 30.0 g of 130 Neutral oil, 30.0 g of CaO lime, 17.5 g of phosphorus pentasulphide, 400 ml of xylene and 100 ml of tetrahydrofuran are introduced into a reactor equipped with an agitator, a Dean and Stark separator and a draining funnel. After mixing, a solution of 14.19 g of water in 150 ml of tetrahydrofuran is introduced drop-by-drop at a temperature not exceeding 50° C. The medium is then heated to a temperature with the range of 50° C. and 70° C. for 2 hours, then, after removal of tetrahydrofuran and water by distillation, 5.0 g of orthoboric acid H3BO3, 2.5 ml of methanol and 5.0 g of CaO lime are introduced, the temperature is maintained at 45° C. for 7 hours. After return to the ambient temperature, the medium is filtered, then the filtrate is evaporated under low pressure. 79 g of a limpid, liquid, homogeneous product is recovered, containing:

Ca=9.7% by weight

P=3.7% by weight

S=7.5% by weight

B=1.0% by weight

EXAMPLE 13

20.0 g of an alkyarylsulphonic acid with an equivalent molar mass equalling 700, 20.0 g of 130 Neutral oil, 25.0 g of CaO lime, 15.0 g of phosphorus pentasulphide, 6.9 g of phosphorus pentoxide, 350 ml of xylene and 100 ml of tetrahydrofuran are introduced into a reactor equipped with an agitator, a Dean and Stark separator and a draining funnel. After mixing, a solution of 8.54 g of water and 6.51 g of methanol in 80 ml of tetrahydrofuran is introduced drop-by-drop at a temperature not exceeding 50° C. The medium is then heated to a temperature with the range of 50° C. and 70° C. for 5 hours, then, after removal of tetrahydrofuran and water by distillation, the medium is heated to the reflux temperature of xylene for 2 hours. After return to the ambient temperature, the medium is filtered, then the filtrate is evaporated under low pressure. 41.0 g of a limpid, liquid, homogeneous product recovered, containing:

Ca=4.8% by weight

P=1.0% by weight

S=5.4% by weight

Calculation of the weight ratio of phosphorous and/or sulfur plus optionally boron to the calcium or magnesium amounts are summarized in the following table:

| Example | 1 | 2 | 3 | 4 | 5 | 6 | 7 | 8 | 9 | 10 | 11 | 12 | 13 |
|---|---|---|---|---|---|---|---|---|---|---|---|---|---|
| ratio | 1.60 | 1.23 | 1.02 | 1.07 | 1.38 | 1.66 | 1.37 | 3.17 | 1.29 | 1.96 | 1.01 | 1.26 | 1.33 |

EXAMPLE 14

Examination of the products by dialysis in heptane through a latex membrane.

The products in examples 1 to 7 and 11 above are submitted to dialysis in solution in normal heptane through a latex membrane. In each experiment, the mass fraction which has dialyzed (the dialyzate) is determined, as is that part which has not dialyzed (the concentrate), the latter being the colloidal part. The concentration of phosphorus and/or sulphur of each fraction is also determined. The results are shown in table I below.

TABLE I

| Product of | CONCENTRATE | | | DIALYZATE | | |
|---|---|---|---|---|---|---|
| | Quantity | Content of elements (% by weight) | | Quantity | Content of elements (% by weight) | |
| example | (% by weight) | P | S | (% by weight) | P | S* |
| 1 | 54.2 | | 10.5 | 45.8 | | 0.3 |
| 2 | 45.4 | 7.8 | 6.0 | 56.4 | 0.0 | 0.3 |
| 3 | 49.3 | 8.3 | 7.3 | 50.7 | 0.0 | 0.3 |
| 4 | 59.8 | 8.3 | 14.0 | 40.2 | 0.0 | 0.4 |
| 5 | 54.9 | 8.1 | 14.0 | 45.1 | 0.0 | 0.3 |
| 6 | 54.4 | 10.4 | 16.0 | 55.6 | 0.0 | 0.4 |
| 7 | 59.6 | 8.1 | 17.3 | 40.4 | 0.0 | 0.5 |
| 11 | 52.2 | 10.2 | 3.6 | 47.8 | 0.0 | 0.4 |

*The sulphur content in the oil used during the synthesis is 0.3% mass.

Examination of the results indicates that sulphur and phosphorus contained in the products according to the invention are found again in full in the concentrate (that is to say in the colloidal fraction), and are absent from the dialyzate.

EXAMPLE 15

Evaluation of the wear-resistance and extreme pressure properties

The products in examples 2 to 4, 8 and 12 were evaluated for their wear-resistance and extreme pressure properties in a 130 Neutral mineral oil.

The wear-resistance and extreme pressure performances were evaluated on a 4 ball machine according to the ASTM D 2783 procedure. The results are shown in table II below.

TABLE II

| Product of example | CONCENTRATION/OIL (% by weight) Additive | Ca | WEAR-RESISTANCE AND EXTREME PRESSURE PERFORMANCE ON 4 BALL MACHINE Load/wear index (daN) | Weld load (daN) | Diameter of impression after 1 hour at 40 daN (mm) |
|---|---|---|---|---|---|
| 2 | 10 | 0.64 | 42 | 250 | 0.45 |
| 3 | 10 | 0.99 | 60 | 315 | 0.46 |
| 4 | 5 | 0.61 | 47 | 250 | 0.47 |
| 4 | 10 | 1.22 | 73 | 400 | 0.47 |
| 8 | 10 | 0.40 | 70 | 400 | 0.46 |
| 12 | 10 | 1.03 | 56 | 400 | 0.50 |
| | | Comparative examples | | | |
| Basic Ca sulphonate 11.90% Ca | 5 | 0.59 | 29 | 170 | 0.75 |
| | 10 | 1.19 | 36 | 200 | 0.36 |

The additives according to the invention show marked wear resistance and extreme pressure properties. The performances obtained are superior to those gathered from classic formulations containing superbasic colloidal additives.

We claim:

1. A colloidal product containing at least one element selected from the group consisting of sulphur and phosphorus, and optionally boron, as well as at least one element selected from the group consisting of magnesium, calcium and zinc, said colloidal product having been produced in micellized form by a neutralization reaction of at least one acid with at least one basic non-micellized derivative of at least one metal selected from the group consisting of magnesium, calcium and zinc, in the presence of at least one surface active agent exempt from overbased product, said acid being selected from the group consisting of:

(1) a sulphurated carboxylic acid corresponding to the general formula $$X—R^1—S_x—R^3—S_y—R^2—COOH$$

in which $R^1$ and $R^2$ each represent a divalent hydrocarbon radical, $R^3$ represents a simple bond or a divalent hydrocarbon radical, X represents a hydrogen atom or a carboxylic group; x and y each have an average value of 1 to 4 when $R^3$ is a divalent hydrocarbon radical and the sum (x+y) has an average value of 1 to 4 when $R^3$ represents a simple bond, and (2) an acid containing sulphur and phosphorous formed in situ between (a) a phosphorus sulphide and (b) water or an aliphatic monoalcohol, or a mixture of water and an aliphatic monoalcohol.

2. A colloidal product according to claim 1, wherein said acid is selected from the group consisting of thio-, dithio, trithio- and tetrathio-diglycolic, -dipropionic and -dibutyric acids, 2,2'-dithiodibenzoic acid, bis-methylene and bis-ethylene (thio-, dithio- and trithioacetic) acids, bis-methylene and bis-ethylene (thio-, dithio- and trithiopropionic) acids and ethylthio-, trithio-, and trithio-acetic, -propionic and -butyric acids.

3. A colloidal product according to claim 2, wherein said acid is dithiodiglycolic acid.

4. A colloidal product according to claim 1, wherein said acid is formed in situ from phosphorus sulphide $P_4S_{10}$ and water or methanol or mixtures thereof.

5. A colloidal product according to one of claims 1 to 4, wherein said acid is used conjointly with at least one additional acid containing phosphorus or boron directly introduced or formed in situ from the corresponding oxides.

6. A colloidal product according to claim 5, wherein said directly introduced additional acid is selected from orthoboric and metaboric acids, phosphoric acid $H_3PO_4$ and derived acids, and said additional acid, formed in situ is selected from acids formed from an oxide of phosphorus and/or an oxide of boron on the one hand, and water and/or an aliphatic monoalcohol on the other hand.

7. A colloidal product according to claim 6, wherein said directly introduced additional acid is phosphoric acid $H_3PO_4$ or boric acid $H_3BO_3$ and said additional acid formed in situ is formed from phosphorus pentoxide $P_2O_5$ and water.

8. A colloidal product according to claim 1, wherein said basic derivative is an oxide, a hydroxide, a carbonate or a magnesium or calcium hydroxycarbonate or zinc oxide.

9. A colloidal product according to claim 1, wherein said surface active agent is a sulphonic acid, or a salt thereof.

10. A colloidal product according to claim 1, wherein the reaction is carried out in the presence of at least one solvent selected from the group consisting of aliphatic and cycloaliphatic hydrocarbons, aromatic hydrocarbons, tetrahydrofuran, carbon sulphide and a dilution oil.

11. A colloidal product according to claim 1, wherein the method is carried out in the presence of a micellization promoter selected from amines, quaternary ammonium compounds, hydrazine and aliphatic alcohols.

12. A colloidal product according to claim 1, wherein the reaction takes place at a temperature of 20° to 140° C. in 30 minutes to 7 hours.

13. A colloidal product according to claim 1, containing by weight: 30% of sulphur and/or up to approximately 15% phosphorus and optionally up to approximately 10% of boron, as well as up to approximately 25% of calcium, and/or up to approximately 20% of magnesium and/or up to approximately 25% of zinc.

14. A lubricating composition wherein it contains a major proportion of at least one mineral or synthetic lubricant and a minor proportion of at least one colloidal product according to claim 1.

15. A lubricating composition according claim 14, wherein the colloidal product is incorporated therein in a concentration by weight of 0.1 to 25%.

16. A colloidal product according to claim 4, wherein said acid is used conjointly with at least one additional acid containing phosphorus or boron directly introduced or formed in situ from the corresponding oxides.

17. A colloidal product according to claim 16, wherein said directly introduced additional acid is selected from orthoboric and metaboric acids, phosphoric acid $H_3PO_4$ and derived acids, and said additional acid, formed in situ is selected from acids formed from an oxide of phosphorus and/or an oxide of boron on the one hand, and water and/or an aliphatic monoalcohol on the other hand.

18. A colloidal product according to claim 17, wherein said directly introduced additional acid is phosphoric acid $H_3PO_4$ or boric acid $H_3BO_3$ and said additional acid formed in situ is formed from phosphorus pentoxide $P_2O_5$ and water.

19. A colloidal product according to claim 4, wherein said basic derivative is an oxide, a hydroxide, a carbonate or a magnesium or calcium hydroxycarbonate or zinc oxide.

20. A colloidal product according to claim 4, wherein said surface active agent is a sulphonic acid, or a salt thereof.

21. A colloidal product according to claim 4, wherein the reaction is carried out in the presence of at least one solvent selected from the group consisting of aliphatic and cycloaliphatic hydrocarbons, aromatic hydrocarbons, tetrahydrofuran, carbon sulphide and a dilution oil.

22. A colloidal product according to claim 4, wherein the method is carried out in the presence of a micellization promoter selected from amines, quaternary ammonium compounds, hydrazine and aliphatic alcohols.

23. A colloidal product according to claim 4, wherein the reaction takes place at a temperature of 20° to 140° C. in 30 minutes to 7 hours.

24. A colloidal product according to claim 4, containing by weight: 30% of sulphur and/or up to approximately 15% phosphorus and optionally up to approximately 10% of boron, as well as up to approximately 25% of calcium, and/or up to approximately 20% of magnesium and/or up to approximately 25% of zinc.

25. A lubricating composition wherein it contains a major proportion of at least one mineral or synthetic lubricant and a minor proportion of at least one-colloidal product according to claim 4.

26. A lubricating composition according to claim 25, wherein the colloidal product is incorporated therein in a concentration by weight of 0.1 to 25%.

27. A colloidal product according to claim 1, wherein the surface active agent is a sulphonic acid.

28. A colloidal product according to claim 1, wherein the weight ratio of the total of phosphorus, sulfur and boron to the total of calcium or magnesium in the colloidal product is 1.01:1 to 3.17:1.

29. A colloidal product according to claim 27, wherein the weight ratio of the total of phosphorus, sulfur and boron to the total of calcium or magnesium in the colloidal product is 1.01:1 to 3.17:1.

30. A colloidal product containing at least one element selected from the group consisting of sulphur and phosphorus, and optionally boron, as well as at least one element selected from the group consisting of magnesium, calcium and zinc, said colloidal product having been produced in micellized form by reaction of at least one acid with at least one basic non-micellized derivative of at least one metal selected from the group consisting of magnesium, calcium and zinc, in the presence of at least one surface active agent, said acid being selected from the group consisting of:

(1) a sulphurated carboxylic acid corresponding to the general formula $$X—R^1—S_x—R^3—S_y—R^2—COOH$$

in which $R^1$ and $R^2$ each represent a divalent hydrocarbon radical, $R^3$ represents a simple bond or a divalent hydrocarbon radical, X represents a hydrogen atom or a carboxylic group; x and y each have an average value of 1 to 4 when $R^3$ is a divalent hydrocarbon radical and the sum (x+y) has an average value of 1 to 4 when $R^3$ represents a simple bond, and (2) an acid containing sulphur and phosphorous formed in situ between (a) a phosphorus sulphide and (b) water or an aliphatic monoalcohol, or a mixture of water and an aliphatic monoalcohol, wherein the weight ratio of the total of phosphorus, sulfur and boron to the total of calcium or magnesium in the colloidal product is 1.01:1 to 3.17:1.

31. A colloidal product according to claim 30, wherein the surface active agent is a sulphonic acid.

* * * * *